12/25/84 XR 4,489,983

SR

United States Patent [19]

Ricketts

[11] Patent Number: 4,489,983

[45] Date of Patent: Dec. 25, 1984

[54] BLASTHOLE SPACING FOR CONTROL OF PARTICLE SIZE

[75] Inventor: Thomas E. Ricketts, Grand Junction, Colo.

[73] Assignee: Occidental Oil Shale, Inc., Grand Junction, Colo.

[21] Appl. No.: 454,449

[22] Filed: Dec. 29, 1982

[51] Int. Cl.[3] ..... E21B 43/263; E21C 41/10

[52] U.S. Cl. ..... 299/2; 299/13; 166/256

[58] Field of Search ..... 299/2, 13; 166/259, 166/299; 102/312, 311

[56] References Cited

U.S. PATENT DOCUMENTS

| | | | |
|---|---|---|---|
| 4,043,595 | 8/1977 | French | 299/13 |
| 4,109,964 | 8/1978 | Ridley | 299/2 |
| 4,149,595 | 4/1979 | Cha | 299/13 |
| 4,366,987 | 1/1983 | Ricketts et al. | 299/2 |

*Primary Examiner*—Stephen J. Novosad
*Assistant Examiner*—William P. Neuder
*Attorney, Agent, or Firm*—Christie, Parker & Hale

[57] ABSTRACT

A method for controlling the average particle size of a fragmented permeable mass of formation particles formed in an in situ retort in a subterranean formation containing oil shale is provided. At least one void is excavated in the subterranean formation, leaving zones of unfragmented formation above and below the void. Such a zone of unfragmented formation has naturally occurring cleavage planes and a substantially horizontal free face adjoining the void. An array of a plurality of substantially vertical blastholes is formed in at least one of the zones of unfragmented formation and each such blasthole is loaded with explosive for forming a substantially horizontal array of explosive charges. The spacing distance between adjacent blastholes or explosive charges in the array is from about 10 to about 15 times the average distance between cleavage planes when the oil shale formation has an average grade of more than about 20 gallons per ton. The spacing distance between adjacent blastholes or explosive charges in the array is from about 15 to about 22 times the average distance between cleavage planes when the oil shale has an average grade of less than about 20 gallons per ton. The explosive charges are detonated for explosively expanding the zone of unfragmented formation toward the void to form a fragmented permeable mass of formation particles in the in situ retort.

23 Claims, 2 Drawing Figures

BLASTHOLE SPACING FOR CONTROL OF PARTICLE SIZE

FIELD OF THE INVENTION

This invention relates to a method for forming an in situ oil shale retort containing a fragmented permeable mass of formation particles in a subterranean formation containing oil shale. More particularly, the invention relates to a method for forming an array of a plurality of blastholes in a subterranean formation containing oil shale for explosively expanding the formation.

BACKGROUND OF THE INVENTION

The presence of large deposits of oil shale in the semi-arid, high plateau region of the western United States has given rise to extensive efforts to develop methods of recovering shale oil from kerogen in the oil shale deposits. It should be noted that the term "oil shale" as used in the industry is, in fact, a misnomer; it is neither shale nor does it contain oil. It is a sedimentary formation comprising a marlstone deposit with layers containing an organic polymer called "kerogen" which, upon heating, decomposes to produce liquid and gaseous products, including hydrocarbon products. It is the formation containing kerogen that is called "oil shale" herein and the liquid hydrocarbon product is called "shale oil".

A number of methods have been proposed for processing oil shale which involve either mining the kerogen-bearing shale and processing the shale on the surface or processing the shale in situ. The latter approach is preferable from the standpoint of environmental impact since the spent shale remains in place, reducing the chance of surface contamination and the requirement for disposal of solid wastes. According to both of these approaches, oil shale is retorted by heating the oil shale to a sufficient temperature to decompose kerogen and produce shale oil which drains from the rock. The retorted shale, after kerogen decomposition, contains substantial amounts of residual carbonaceous material which can be burned to supply heat for retorting.

One technique for recovering shale oil includes forming an in situ oil shale retort in a subterranean formation containing oil shale. At least a portion of the formation within the boundaries of the in situ oil shale retort is explosively expanded to form a fragmented permeable mass of particles containing oil shale. The fragmented mass is ignited near the top of the retort to establish a combustion zone. An oxygen-supplying gas is introduced into the top of the retort to sustain the combustion zone and cause it to move downwardly through the fragmented permeable mass of particles in the retort. As burning proceeds, the heat of combustion is transferred to the fragmented mass of particles below the combustion zone to release shale oil and gaseous products therefrom in a retorting zone. The retorting zone moves from the top to the bottom of the retort ahead of the combustion zone and the resulting shale oil and gaseous products pass to the bottom of the retort for collection and removal. Recovery of liquid and gaseous products from oil shale deposits is described in greater detail in U.S. Pat. No. 3,661,423 to Donald E. Garrett which is incorporated herein by this reference.

An in situ oil shale retort can be formed by blasting to a horizontal free face. In such a technique, a void is excavated in a subterranean formation containing oil shale with horizontal free faces above and/or below such a void. A plurality of blastholes are drilled perpendicular to the free face for containing a plurality of columnar explosive charges. The charges in the blastholes are then detonated for explosively expanding oil shale formation toward the voids for forming the fragmented permeable mass of formation particles in the retort. Examples of such techniques for forming in situ oil shale retorts are described in U.S. Pat. No. 4,043,597 to French, U.S. Pat. No. 4,043,598 to French et al, and U.S. Pat. No. 4,192,552 to Ricketts, which are incorporated herein by this reference.

It is desirable when forming a fragmented mass in an in situ retort to control the average particle size of the fragmented mass. Some control of the average particle size can be obtained by selecting the powder factor of the explosive used for blasting. Powder factor is the quantity of explosive used to fragment a given quantity of oil shale. For example, powder factor can be stated as pounds of explosive per ton of oil shale rubble produced. By increasing the powder factor, the average particle size in the fragmented mass can normally be reduced.

It is desirable in forming an in situ oil shale retort to have a large spacing distance between adjacent explosive charges. When a larger spacing distance is employed, cost can be reduced. The number of holes drilled is reduced, which lowers cost for drilling and loading the blastholes, as well as reducing the cost and complexity of the system for detonating the explosive charges.

It has been discovered, however, that there is an upper limit on the spacing distance between explosive charges in oil shale. If this limit is exceeded, the ability to control average particle size by changing powder factor is lost and the particles produced are larger then desired. The center regions of such large particles may not be properly retorted during subsequent retorting operations, thereby reducing product yields.

It is desirable, therefore, to provide a method for expanding oil shale formation that includes placing adjacent blastholes (and thus explosive charges) as far apart as possible, while still being able to control the average particle size of the fragmented mass being formed by adjusting powder factor.

SUMMARY OF THE INVENTION

This invention relates to a method for explosively expanding formation containing oil shale, while controlling the particle size of the fragmented mass being formed. An array of a plurality of blastholes that are approximately perpendicular to a free face of formation containing oil shale is provided. The oil shale containing formation has naturally occurring cleavage planes. The spacing distance (S) between adjacent blastholes in the array is related to the average distance (D) between such cleavage planes such that the ratio of S/D is from about 10 to about 22.

When the oil shale formation has an average grade of less than about 20 gallons per ton, the ratio of S/D is preferably from about 15 to about 22. When the oil shale has an average grade of more than about 20 gallons per ton, the ratio of S/D is preferably from about 10 to about 15.

DRAWINGS

These and other features, aspects, and advantages of the present invention will be more fully understood when considered with respect to the following detailed description, appended claims, and accompanying drawings wherein:

FIG. 1 is a fragmentary, semi-schematic, vertical cross-section of an arrangement for forming an in situ oil shale retort; and FIG. 2 is a fragmentary, horizontal cross-section through the retort site of FIG. 1.

DETAILED DESCRIPTION

Figure 1:
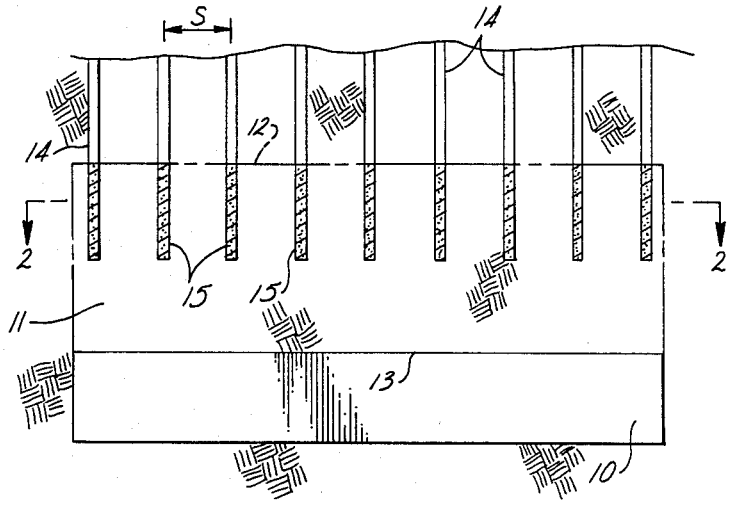
Figure 2:
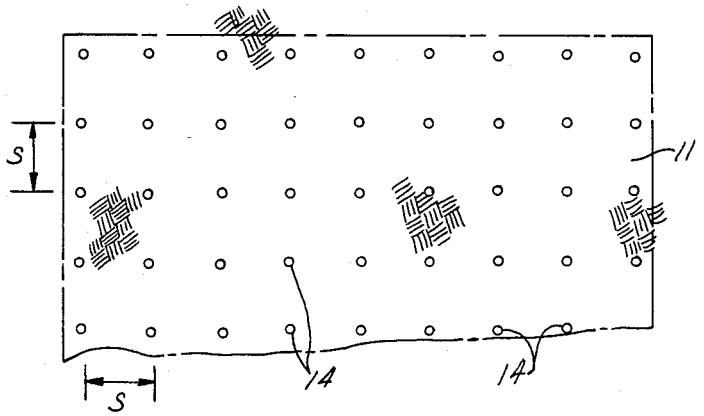

FIGS. 1 and 2 are fragmentary views in vertical and horizontal cross-section, respectively, of an in situ oil shale retort site at an intermediate stage during formation of the retort. As illustrated therein, a horizontally extending void 10 is excavated in a subterranean formation containing oil shale, leaving a zone 11 of unfragmented formation immediately above the void as indicated by a phantom line 12. In an exemplary practice of this invention, the zone 11 of unfragmented formation is explosively expanded towards the free face 13 at the top of the void 10. An array of a plurality of blastholes 14 is drilled into the zone with the blastholes being approximately perpendicular to the free face 13. The blastholes are loaded with explosive charges 15. Detonation of the explosive charges explosively expands the zone of unfragmented formation towards the void to form a fragmented permeable mass of formation particles in the retort.

This application concerns an arrangement of explosive charges for such expansion and the fragmentary drawings suffice for a description of the method. It will be understood that the principles are applicable to a variety of arrangements for forming in situ oil shale retorts such as described in greater detail in the aforementioned patents.

Thus, for example, the zone of unfragmented formation can be below such a void instead of above it. Alternatively, zones of unfragmented formation both above and below such a void can be expanded towards the void either sequentially or simultaneously. In another embodiment, vertically spaced apart horizontal voids can be excavated in the subterranean formation leaving a zone of unfragmented formation between the voids. Such a zone can be explosively expanded towards both the upper and lower voids. Alternatively, a relatively larger void can be excavated and overlying formation explosively expanded downwardly towards that void in a sequence of zones explosively expanded in a single round or in a series of rounds. A variety of combinations and permutations of these alternatives can be practiced and several are described and illustrated in the above mentioned patents.

It will also be appreciated by one skilled in the art that other variations can be involved during formation of a retort, such as inclusion of a temporary roof supporting pillar within the boundaries of the void 10. Explosive charges can be placed in such a pillar for detonation in advance of detonation of explosive charges in an adjacent zone, thereby removing the pillar a very short time before explosive expansion of formation towards the horizontal free face. No such pillar is illustrated in FIG. 1 for simplicity.

In FIG. 1, the blastholes 14 are drilled downwardly into the overlying zone of formation. Such drilling can be from an overlying subterranean base of operation or from the ground surface. If desired, such blastholes can be drilled upwardly from the void 10.

As indicated in FIG. 2, the retort has a rectangular horizontal cross-section. The cross-section can be square or any other desired configuration. Many other variations will be apparent and need not be described in detail.

In the illustrated embodiment, the void 10 is a "limited void" with respect to the volume of formation to be explosively expanded towards that void. That is, the void has less available volume than would be required for free expansion of formation towards the void. Practice of this invention is also useful for explosive expansion of formation towards voids other than limited voids.

When an earth formation is explosively fragmented and expanded, it increases in bulk due to the void space in interstices between the particles. The maximum expansion of an oil shale formation into an unlimited void results in a fragmented mass having an average void fraction of about 38%; that is, about 38% of the total volume occupied by the fragmented mass is void space between the particles.

A "limited void" is one where the void space available for explosive expansion is less than needed for free bulking of the formation expanded towards that void. Thus, if a void has an excavated volume less than about 38% of the total of the volume of the void plus the volume occupied by formation explosively expanded, it is necessarily a limited void. It has been found that factors in addition to total available void can make a void "limited" even though the total available void may appear sufficient for free bulking.

Additional information regarding limited voids can be found in U.S. Pat. No. 4,336,966 which is incorporated herein by this reference.

Columnar explosive charges 15 are loaded into blastholes in the unfragmented zone 11 with the axis of each such charge extending perpendicular to the free face 13. Collectively, the explosive charges form an array with the centroids of the charges lying approximately in a plane parallel to the free face. In the embodiment illustrated in FIG. 1, the explosive charges are loaded so as to extend from approximately the middle of the zone of unfragmented formation to the boundary 12 remote from the horizontal free face 13. Above that boundary, the blastholes are stemmed with inert materials (not shown), however, in an embodiment where an adjacent zone is also explosively expanded towards an overlying void, explosive can extend beyond the upper boundary 12 as described in the aforementioned patents.

The array of explosive charges 15 can be defined in terms of actual depth of burial of explosive charges from the free face (DOB), scaled depth of burial of the explosive charges (sdob), and spacing distance between adjacent blastholes or charges (S).

In the illustrated pattern, the array of blastholes 14 is square; that is, the distance between adjacent blastholes or charges in the blastholes in orthogonal directions (the spacing distance (S)), is approximately the same. In some embodiments, the blastholes can be in a rectangular array where the distance in one direction is somewhat longer than in the other direction and, in other embodiments, a generally triangular arrangement can be employed with the blastholes in adjacent rows being staggered from each other. Average spacing distances are referred to in such embodiments.

The actual depth of burial (DOB) of an explosive charge is the distance from the free face to the effective center or centroid of the explosive charge.

The scaled depth of burial (sdob) can be defined for each explosive charge 15 in each blasthole 14 and, in addition, an equivalent scaled depth of burial can be defined for the array of explosive charges. This concept is described in greater detail below.

To provide an array of blastholes with a spacing distance (S) in accordance with practice of this invention to enable control of the average particle size of the fragmented mass formed, several variables can be considered. The first is the average distance (D) between naturally occurring cleavage planes along which the formation will preferentially fracture when blasted and the second is oil shale grade.

Such cleavage planes or joints in an oil shale formation are primarily in three sets of orthogonal orientations. One set of joints is approximately parallel to the bedding planes. The other two sets of joints are roughly orthogonal to the bedding planes and to each other. Additional joints are outside these principal sets, more or less randomly spaced and oriented. Most of the joints are in the three orthogonal sets. The orientation, extent, and average spacing or distance between joints can be determined for the oil shale formation by surveys of fractured rock. As used herein, the average distance between joints refers to the average distance between the joints in all three principal sets. For example, in a typical oil shale deposit in the Piceance Creek Basin in western Colorado, the average joint spacing or distance between cleavage planes in oil shale formation is on the order of about 1.5 feet.

Additional information regarding cleavage planes in oil shale formation can be found in application Ser. No. 837,521 filed Sept. 29, 1977, by Irving G. Studebaker and entitled "METHOD OF FORMING AN IN SITU OIL SHALE RETORT". Application Ser. No. 837,521 is incorporated herein by this reference.

In practice of this invention, it is preferable that the spacing distance (S) between adjacent blastholes in the array is less than about 22 times the average distance (D) between such cleavage planes. The value 22 has been found to be about the largest spacing distance that can be used between blastholes which will provide a fragmented permeable mass having an acceptable average particle size for in situ oil shale retorting.

Oil shale grade is conventionally characterized by what is known as a Fischer assay rather than directly as kerogen content. This is a standard test in which a comminuted sample of oil shale is heated in a closed vessel at a standard rate. The quantity of shale oil extracted from the oil shale is measured. The Fischer assay or grade of oil shale is conveniently stated in units of gallons per ton; that is, gallons of shale oil recoverable from a ton of oil shale under the specified heating conditions. The actual yield of shale oil from a given formation can differ when retorting conditions are different from the Fischer assay. The Fischer assay, however, provides a standard for comparing oil shale formations.

As used in this specification, the term "lean oil shale" refers to oil shale having an average Fischer assay less than about 20 gallons per ton. For example, three in situ oil shale retorts have been constructed in formation containing oil shale, wherein the fragmented mass in the retort had an average grade of 15.7, 16.1, and 19.3 gallons per ton, respectively. These retorts are considered to have been formed in lean oil shale. As is used herein, the term "rich oil shale" refers to formation containing oil shale having an average grade over about 20 gallons per ton.

It will be recognized that oil shale is a lamellar formation having many deposition layers having different kerogen content or grade. Thus, in a formation, there can be layers completely devoid of organic material and other layers having a Fischer assay as high as 100 gallons per ton. Explosive expansion for forming a fragmented mass of particles in an in situ oil shale retort is not greatly influenced by such local variations in grade, and it is appropriate to consider the average grade of formation containing oil shale. For example, the average grade in zones about 30 to 50 feet thick can be appropriate for consideration of explosive expansion.

In accordance with this invention, when oil shale has an average grade of more than about 20 gallons per ton (rich oil shale), preferably the ratio of spacing distance (S) to the average distance between joints (D) is less than about 13. When the ratio of spacing distance to the average distance between joints is more than about 13, some of the formation can fracture largely along the joints and relatively large particles are produced. Such large particles, as is mentioned above, may not be completely retorted and, thus, yields from the retort can be reduced. The ratio of spacing distance to the average distance between joints in rich oil shale can be in the range of from about 10 to about 15. If the ratio is less than about 10, an excessive number of blastholes is required and the cost becomes prohibitive. Further, in some embodiments, it can be extremely difficult to place blastholes close together because of requirements for pillars supporting overburden. When the ratio of spacing distance (S) to the average distance between joints (D) is more than about 15 in such rich oil shale, an excessive proportion of the fragmented formation can be in large particles that do not successfully retort.

When the ratio of (S) to (D) is from about 13 to about 15 in rich oil shale, a small proportion of the formation between blastholes can be in large particles, the size of which is determined by the average distance between joints, without severe loss of shale oil yield. Some proportion of large particles can be tolerated considering the proportion of lost yield and the cost of a smaller spacing distance.

When the oil shale has an average grade of less than about 20 gallons per ton (lean oil shale), it is preferred that the ratio of spacing distance (S) to the average distance between joints (D) be less than about 19. When the ratio of spacing distance to the average distance between joints is more than about 19, some of the formation fractures largely along joints and relatively large particles are produced. The ratio of spacing distance to the average distance between joints can be in the range of from about 15 to about 22 for such lean oil shale. If the ratio of spacing distance (S) to the average distance between joints (D) is less than about 15 for lean oil shale, an excessive number of blastholes is required and the cost becomes prohibitive. If the ratio is more than about 22, an excessive proportion of the fragmented formation of the lean oil shale can be in large particles that do not successfully retort.

In addition to defining the desired spacing distance between blastholes or explosive charges, preferably the scaled depth of burial of the explosive array is maintained within the range that tends to provide control of the average particle size of the fragmented mass formed by detonation of the charges.

The scaled depth of burial as it applies to cratering or explosive expansion towards a free face is described by Bruce B. Redpath in an article entitled "Application of Cratering Characteristics to Conventional Blast Design", *Monograph* 1 *on Rock Mechanics Applications in Mining,* Soc. Min. Eng. and Am. Inst. Min. Met. and Pet. Eng., New York, 1977, a copy of which accompanies this application and which is incorporated herein by reference. Although the relations set forth are derived for an essentially infinite free face, the principles have been found applicable for explosive expansion towards a limited void.

The point charge scaled depth of burial (sdob) of an explosive charge can be expressed in units of distance over weight of explosive to the one-third power or, preferably, distance over explosive energy to the one-third power. The sdob of a point charge, for example, is given by sdob equals $DOB/W^{\frac{1}{3}}$ where DOB is the actual depth of burial or burden of the charge from the free face and W is the weight of the charge. It is often preferable to state the sdob in terms of explosive energy rather than weight, hence the units $mm/cal^{\frac{1}{3}}$. In the Redpath paper, sdob is stated in terms of $ft/lb^{\frac{1}{3}}$ and this can be approximately converted to $mm/cal^{\frac{1}{3}}$ by multiplying by about four for a number of common types of explosive.

As is mentioned above, a point charge scaled depth of burial can be defined for each explosive charge in each blasthole and, in addition, an equivalent point charge scaled depth of burial can be defined for an array of explosive charges.

The same effective scaled depth of burial for an array of explosive charges can be obtained with a variety of patterns of blastholes. For example, the same effective scaled depth of burial of an array can be obtained with either (a) relatively more energetic explosive charges with relatively large spacing between holes, or (b) relatively less energetic explosive charges with relatively smaller spacing between holes.

The scaled depth of burial of an array of explosive charges can be altered by changing the amount of explosive in each blasthole, by changing the actual depth of burial of the explosive charge in each blasthole, by changing the diameter of each blasthole (hence, the amount of explosive), by using a more or less energetic explosive in each blasthole, and/or by changing the array of blastholes so that they are spaced either closer or farther apart.

A relation similar to the sdob of a point charge can be written for a plane charge; that is, where the explosive charge is considered to form a plane substantially parallel to the free face and located in the unfragmented formation to be explosively expanded. The relation is $sdob_{pl}=DOB_{pl}/(w/s^2)$ where the subscript pl indicates a plane, $DOB_{pl}$ indicates the actual depth of burial of the plane, and $w/s^2$ is the charge weight per unit area of such a plane explosive charge. In this equation, the plane charge need not be continuous, but can consist of separate cylindrical charges in blastholes of a blasthole array. It will be noted that $sdob_{pl}$ has the units of $(l^3/w)^1$ where l is a linear dimension and w is a charge weight. Thus, $sdob_{pl}$ is the inverse of a powder factor (PF) where powder factor is the weight of an explosive charge per unit volume of formation explosively expanded.

A useful equation relating plane scaled depth of burial to the equivalent point charge scaled depth of burial of the array is $$DOB_{pl}=sdob_{pt}^3\cdot(w/s^2)\ .$$

This equation can be used in either of two ways: (a) given a blast array using cylindrical explosive charges, one can calculate directly $(w/s^2)$, actual $DOB_{pl}$ and the equivalent point charge $sdob_{pt}$ of the array of explosive charges, using the relation $sdob_{pt}=[DOB_{pl}/(w/s^2)]^{\frac{1}{3}}$; or (b) given a point charge scaled depth of burial that one wants to obtain using an array of cylindrical explosive charges, one can first determine $sdob_{pt}^3$ and then, knowing the scale of the blasthole array that is practical for use (for example, the depth of blastholes, size of blastholes, and type of explosive to be used), calculate $DOB_{pl}$ and W where W is the charge weight per hole. The required hole spacing or spacing distance S between cylindrical explosive charges to obtain the equivalent point charge can be calculated from $$S=[W\cdot sdob_{pt}^3/DOB_{pl}]^{\frac{1}{2}}.$$

This equation is appropriate for a square array where S is the distance between adjacent blastholes as shown in FIG. 2. If an unequal rectangular array is used, the spacing between blastholes should be such that the product of the length of a side times the length of another side of such a rectangle is equal to the value of $s^2$.

Summarizing, the equivalent point charge scaled depth of burial of the entire array is thus $$sdob_{pt}=(DOB\cdot S^2)^{166}/W^{\frac{1}{3}}$$

where the actual array DOB is equal to the actual individual charge depth of burial, S is the spacing distance, and W is the charge weight per hole in the array.

It is conventionally considered that a stronger formation, i.e., one having a higher compressive strength, requires more energy for explosive expansion than a weaker formation. An exception is very loosely consolidated formation which can also require high energy for explosive expansion. In oil shale formation, the average grade or kerogen content of the oil shale has a significant influence on the energy and explosive distribution needed for good fragmentation and explosive expansion. Generally speaking, rich oil shale requires more energy than lean oil shale for proper explosive expansion, which is contrary to the conventional view. This is believed due to the high organic content of the rich oil shale and resulting plasticity or energy attenuation by such organic material in the formation.

In rich oil shale, it is preferred that the array of explosive charges have an equivalent scaled depth of burial in the range of from about 6 to about 9 $mm/cal^{\frac{1}{3}}$. When the scaled depth of burial is less than about 6 $mm/cal^{\frac{1}{3}}$, an excessive proportion of fine particles can be produced due to an excess of energy. If the scaled depth of burial is more than about 9 $mm/cal^{\frac{1}{3}}$, particle size can be largely controlled by joint spacing due to lack of energy, and an excess proportion of large particles can be produced.

Preferably, the scaled depth of burial for an array of explosive charges in lean oil shale is in the range of from about 9 to about 12 $mm/cal^{\frac{1}{3}}$. When the scaled depth of burial is less than about 9 $mm/cal^{\frac{1}{3}}$, an excessive proportion of fine particles can be produced in the lean oil shale and, if the sdob is more than about 12 $mm/cal^{\frac{1}{3}}$, particle size can be largely controlled by joint spacing.

Although specifically described with respect to expansion downwardly towards an underlying void with a square array of blasting holes, it will be apparent that many modifications and variations of this technique can be employed for forming an in situ oil shale retort, examples of which are suggested above.

For example, an in situ retort can be formed with plural voids and/or plural zones expanded upwardly and/or downwardly towards such a void and/or voids. In a retort having more than one zone to be explosively expanded, the grade of oil shale in such zones can differ. It can be desirable in such a situation to use an array of explosive charges in each zone having a spacing distance and array scaled depth of burial suitable for the richest average grade of oil shale in any of such zones. This assures adequate energy for explosively expanding the richest zone and promotes uniformity of void fraction distribution when such zones are explosively expanded in a single round.

A "single round" as used herein means detonation of a number of separate explosive charges, either simultaneously or with only a short time delay between separate detonations. A time delay between explosions in a sequence is short when formation explosively expanded by detonation of one explosive charge has either not yet moved or is still in motion at the time of detonation of a subsequent explosive charge.

Although in practice of principles of this invention the explosive charges can be detonated simultaneously, preferably the charges are detonated in a single round time delay pattern to promote uniformity of void fraction distribution and permeability of the fragmented mass being formed and to reduce total shock and concussion to the surrounding mine.

It is, therefore, to be understood that such variations are within the scope of this invention and should not be limited except as provided in the following claims.

What is claimed is:

1. A method for explosively expanding formation containing oil shale comprising forming an array of a plurality of blastholes that are approximately perpendicular to a free face of formation containing oil shale and having naturally occurring cleavage planes, the spacing distance (S) between adjacent blastholes in the array being related to the average distance (D) between such cleavage planes such that the ratio of S/D is from about 10 to about 22.

2. The method according to claim 1 wherein the oil shale has an average grade of less than 20 gallons per ton and the ratio of S/D is from about 15 to about 22.

3. The method according to claim 2 wherein the ratio of S/D is less than about 19.

4. The method according to claim 1 wherein the oil shale has an average grade of more than about 20 gallons per ton and the ratio of S/D is from about 10 to about 15.

5. The method according to claim 4 wherein the ratio of S/D is less than about 13.

6. A method for explosively expanding formation containing oil shale comprising the steps of:

forming an array of a plurality of blastholes that are approximately perpendicular to a free face of formation containing oil shale and having naturally occurring cleavage planes, the spacing distance between adjacent blastholes in the array being:

in the range of about 10 to about 15 times the average distance between such cleavage planes when such oil shale has an average grade of more than about 20 gallons per ton; and in the range of about 15 to about 22 times the average distance between such cleavage planes when such oil shale has an average grade of less than about 20 gallons per ton.

7. The method according to claim 6 wherein the spacing distance between adjacent blastholes in the array is:

less than about 13 times the average distance between such cleavage planes when such oil shale has an average grade of more than about 20 gallons per ton; and less than about 19 times the average distance between such cleavage planes when such oil shale has an average grade of less than about 20 gallons per ton.

8. A method for explosively expanding subterranean formation containing oil shale having an average grade of more than about 20 gallons per ton, the method comprising:

excavating formation to form at least one void in the subterranean formation, leaving zones of unfragmented formation above and below the void, such a zone of unfragmented formation having cleavage planes and a free face adjacent the void;

forming an array of a plurality of mutually spaced apart blastholes in at least one of such zones of unfragmented formation, the blastholes in the array being approximately perpendicular to the free face and having a spacing distance between adjacent blastholes in the range of about 10 to about 15 times the average distance between such cleavage planes in such oil shale formation;

placing explosive into each blasthole for forming an array of explosive charges; and detonating the explosive charges in the array for explosively expanding the oil shale formation.

9. The method according to claim 8 wherein the array of explosive charges has an equivalent scaled depth of burial in the range of from about 6 mm/cal$^{\frac{1}{3}}$ to about 9 mm/cal$^{\frac{1}{3}}$.

10. The method according to claim 8 wherein the explosive charges in the array are detonated in a single round.

11. The method according to claim 8 wherein the ratio of spacing distance between adjacent blastholes to the average distance between cleavage planes is less than about 13.

12. The method according to claim 8 wherein such a void is a limited void.

13. A method for explosively expanding subterranean formation containing oil shale, having an average grade of less than about 20 gallons per ton, the method comprising:

excavating formation to form at least one void in the subterranean formation, leaving zones of unfragmented formation above and below the void, such a zone of unfragmented formation having cleavage planes and a free face adjacent the void;

forming an array of a plurality of mutually spaced apart blastholes in at least one of such zones of unfragmented formation, the blastholes in the array being approximately perpendicular to the free face and having a spacing distance between adjacent blastholes in the range of about 15 to about 22 times the average distance between such cleavage planes in such oil shale formation;

placing explosive into each blasthole for forming an array of explosive charges; and detonating the explosive charges for explosively expanding the oil shale formation.

14. The method according to claim 13 wherein the array of explosive charges has an equivalent scaled depth of burial in the range of from about 9 mm/cal$^{\frac{1}{3}}$ to about 12 mm/cal$^{\frac{1}{3}}$.

15. The method according to claim 13 wherein the ratio of spacing distance between adjacent blastholes to the average distance between cleavage planes is less than about 19.

16. The method according to claim 13 wherein the explosive charges in the array are detonated in a single round.

17. The method according to claim 13 wherein such a void is a limited void.

18. A method for forming an in situ oil shale retort in a subterranean formation containing oil shale having an average grade of more than about 20 gallons per ton, such an in situ oil shale retort containing a fragmented permeable mass of formation particles containing oil shale, the method comprising the steps of:

excavating formation to form at least one void in the subterranean formation, leaving zones of unfragmented formation above and below such a void, such a zone of unfragmented formation having cleavage planes and a substantially horizontal free face adjoining the void;

forming a plurality of substantially vertical, horizontally spaced apart blastholes in at least one of the zones of unfragmented formation for forming an array of spaced apart blastholes having a spacing distance between adjacent blastholes in the range of about 10 to 15 times the average distance between such cleavage planes;

placing explosive into each such blasthole for forming a substantially horizontal array of explosive charges in the zone of unfragmented formation; and detonating the explosive charges for explosively expanding such a zone of unfragmented formation toward the void to form a fragmented permeable mass of formation particles containing oil shale in the in situ oil shale retort.

19. The method according to claim 18 wherein the array of explosive charges has an equivalent scaled depth of burial in the range of from about 6 mm/cal$^{\frac{1}{3}}$ to about 9 mm/cal$^{\frac{1}{3}}$.

20. The method according to claim 18 wherein the ratio of spacing distance between adjacent blastholes to the average distance between cleavage planes is less than about 13.

21. A method for forming an in situ oil shale retort in a subterranean formation containing oil shale having an average grade of less than about 20 gallons per ton, such an in situ oil shale retort containing a fragmented permeable mass of formation particles containing oil shale, the method comprising the steps of:

excavating formation to form at least one void in the subterranean formation, leaving zones of unfragmented formation above and below such a void, such a zone of unfragmented formation having cleavage planes and a substantially horizontal free face adjoining the void;

forming a plurality of substantially vertical, horizontally spaced apart blastholes in at least one of the zones of unfragmented formation for forming an array of spaced apart blastholes having a spacing distance between adjacent blastholes in the range of about 15 to 22 times the average distance between such cleavage planes;

placing explosive into each such blasthole for forming a substantially horizontal array of explosive charges in the zone of unfragmented formation; and detonating the explosive charges for explosively expanding such a zone of unfragmented formation toward the void to form a fragmented permeable mass of formation particles containing oil shale in the in situ oil shale retort.

22. The method according to claim 21 wherein the array of explosive charges has an equivalent scaled depth of burial in the range of from about 9 mm/cal$^{\frac{1}{3}}$ to about 12 mm/cal$^{\frac{1}{3}}$.

23. The method according to claim 21 wherein the ratio of spacing distance between adjacent blastholes to the average distance between cleavage planes is less than about 19.

* * * * *